United States Patent [19]

Gillis

[11] 4,265,259

[45] May 5, 1981

[54] TENT

[76] Inventor: Robert E. Gillis, P.O. Box 67, Aptos, Calif. 95003

[21] Appl. No.: 46,341

[22] Filed: Jun. 7, 1979

[51] Int. Cl.[3] ..... A45F 1/16

[52] U.S. Cl. ..... 135/1 R; 52/80

[58] Field of Search ..... 135/1, 3, 4, 15 PQ; 52/80, 81

[56] References Cited

U.S. PATENT DOCUMENTS

| | | | |
|---|---|---|---|
| 2,976,876 | 3/1961 | Lonnqvist | 135/3 E |
| 3,233,617 | 2/1966 | Stern | 135/1 R |
| 3,269,398 | 8/1966 | Holbitz | 135/3 R |
| 3,480,023 | 11/1969 | McConnell et al. | 135/3 R |
| 3,625,235 | 12/1971 | Gorgichuk | 135/3 R |
| 4,068,404 | 1/1978 | Sheldon | 135/1 R X |
| 4,077,417 | 3/1978 | Beavers | 135/15 PQ |
| 4,099,533 | 7/1978 | Gillis | 135/3 E |

FOREIGN PATENT DOCUMENTS

| | | | |
|---|---|---|---|
| 681598 | 3/1964 | Canada | 135/3 R |
| 2521913 | 11/1976 | Fed. Rep. of Germany | 135/3 E |
| 1,277,407 | 10/1961 | France | 135/3 R |

*Primary Examiner*—J. Karl Bell

*Attorney, Agent, or Firm*—Robert G. Slick

[57] ABSTRACT

A tent is provided wherein the poles are a series of stressed, arcuate rods which surround a convex polyhedra such as a hemispherical structure. The arcuate rods are approximately in the configuration of segments of circles and they cross at a plurality of points and fit in sockets at each point of crossing and the crossing point is fastened to the membrane forming the tent.

8 Claims, 5 Drawing Figures

TENT

SUMMARY OF THE INVENTION

The present invention relates to a tent preferably of generally hemispherical shape which is held up by a plurality of external poles. The poles are bent and held in tension in an arcuate shape which approximates segments of circles.

In my previous U.S. Pat. Nos. 3,986,519 and 4,099,533 I described and claimed a tent having a plurality of arcuate poles wherein there was a sliding connection between the poles at each of the crossing points.

The present invention differs from my prior patented structures primarily in the fact that instead of employing sliding connections at the crossing points, the crossing points are fixed together so that the crossing points as well as the tent fabric are held in a substantially fixed relationship. The crossing points are defined by collars or couplings which serve to connect adjacent short rods which are thus coupled together to form the long poles to support the tent. At the crossing points, crossed couplings are employed and these may be fixed rigidly together or the connection may be flexible to allow twisting movement. In any event, the crossed coupling is connected to the tent membrane by a fixed or by a flexible member, such as a cord, neither of which permits sliding movement as in my previous patents.

This type of connection is highly desirable for many purposes. In the first place, the couplings permit the use of short rods which are connected together to form the long poles to support the tent. This is particularly important for a backpacking tent. Secondly, the connectors can be left attached to the tent when the tent is taken down and packed. This eliminates the necessity of carrying loose parts and greatly simplifies the subsequent erection of the tent. Tents must be frequently erected under adverse conditions such as darkness, wind and rain and also are often used by inexperienced hikers so that the ease of erection is very important.

DESCRIPTION OF THE PREFERRED EMBODIMENTS

Figure 5:
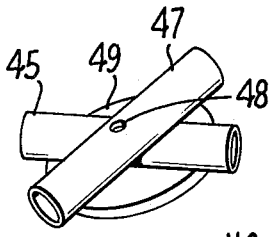
FIG. 5 is a perspective view of an alternate embodiment of a crossing element.
Figure 1:
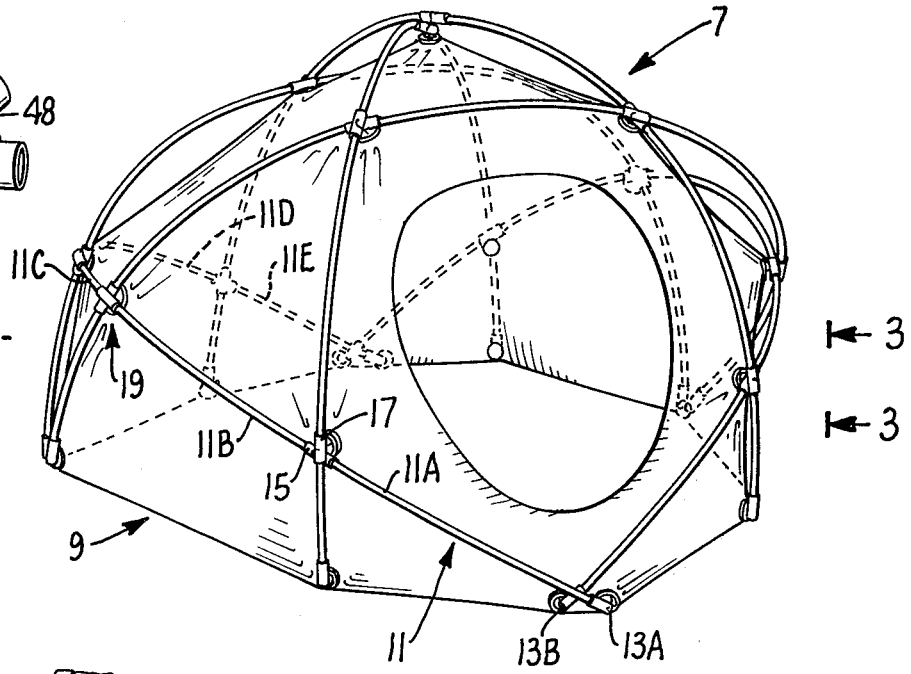
FIG. 1 is a perspective view of a tent embodying the present invention.
Figure 2:
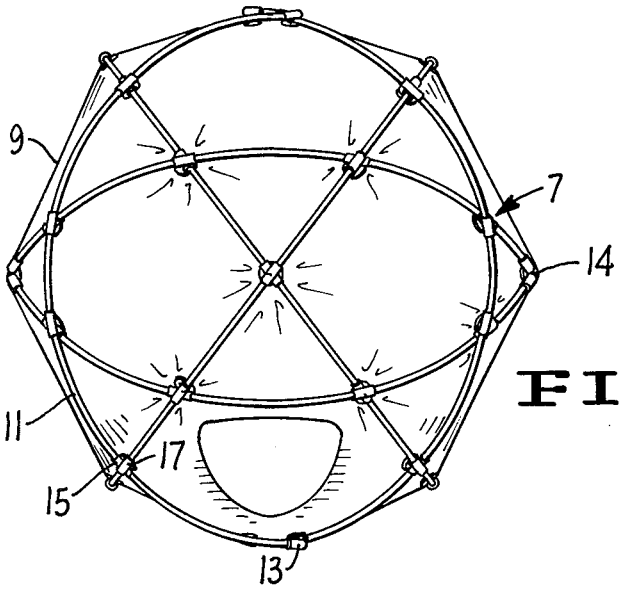
FIG. 2 is a plan view of the tent on a reduced scale.
Figure 4:
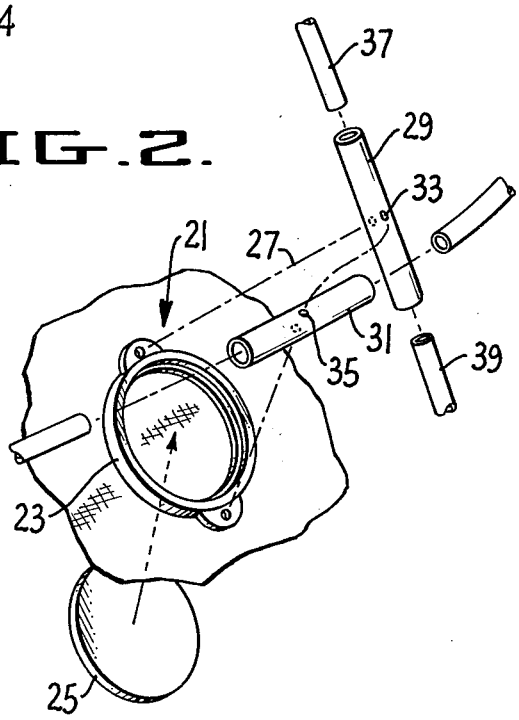
FIG. 4 is an exploded view of the parts shown in FIG. 3.
Figure 3:
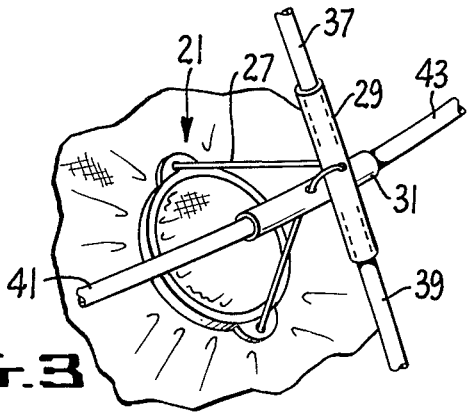
FIG. 3 is an enlarged detailed view on the line 3—3 of FIG. 1.

Referring now to the drawings by reference characters, there is shown a tent having an external framework, generally designated 7, supporting a membrane, generally designated 9. The framework 7 consists of a plurality of stressed poles, generally in the form of segments of circles which start at the bottom of the tent and pass over a portion of the tent to generally define a convex, typically hemispherical structure. The arcuate segments cross at a number of points and at each of these points the short rods are held together in sockets and the socket crossing is also joined to the membrane of the tent. The rods can be loose in the sockets and held in place by tension. The rods are placed in the sockets by bending the rods or stretching the skin. Tracing a typical pole, generally designated 11, the pole starts at the bottom of the tent and is held by clip 13A to a point near the bottom of the membrane forming the tent structure. The pole then goes to a crossing member including a first collar 15 which crosses a second collar 17 at an angle thereto. The pole then extends to a second crossing, generally designated 19, of the same structure. The pole 11 can be thought of as a continuous pole extending from one terminal edge of the tent to the other but actually is made up of short rod segments wherein the collar members, such as the collar 15, serve to couple two adjacent sections of the rod together. Thus, pole 11 actually consists of the short rod segments 11A, 11B, 11C, 11D and 11E coupled together by the collars to form a long tent pole. At the bottom of the tent, separate collars can be used for each rod as shown at 13A and 13B or a double collar can be used as shown at 14. The collars employed on the body of the tent are later described in detail.

At the crossings it is advantageous to use a clip such as that shown in my co-pending U.S. Pat. application Ser. No. 825,410, filed Aug. 17, 1977. The method of using such a clip as well as a typical collar crossing structure is shown in FIGS. 1–4 and particularly in FIGS. 3 and 4. The clip is generally designated 21 and consists of three main parts, namely a ring 23 which lies on the outer surface of the tent fabric, a disc 25 which lies under the surface of the tent fabric and which is pushed up into ring 23 to clamp the same and a loop 27 which extends between opposite edges of ring 23. One method of employing such a loop for the dual purpose of fastening the rods together at a crossing and also fastening the rods to the tent fabric is to employ two couplings 29 and 31 having holes 33 and 35 passing through the respective couplings. Rod sections 37 and 39 are engaged by the coupling 29 while similar segments 41 and 43 are held together by the coupling 31. Now, at a crossing one passes the flexible member 23 through the openings 33 and 35 which holds the poles in a fixed but flexible relationship both with respect to each other and to the tent fabric.

Another type of coupling is shown in FIG. 5. Here the couplings 45 and 47 are rigidly fastened together by known means such as by being welded together or to plate 49. If this method of forming the couplings is employed, the loop 27 can be merely passed between the crossing members or the couplings can have a hole 48 through which the cord passes.

It is not necessary that the connection between the coupling and the membrane be flexible. Thus, the coupling could be sewn to the tent fabric or the plate 49 could form part of a clip structure. It is neither necessary nor ordinarily desirable to remove the couplings from the tent membrane when taking the tent down. This simplifies erecting the tent, packing it and taking the tent down.

In the drawings, each fastener has been shown as having one coupling (e.g. 13A), two couplings (e.g. 14) or four couplings, i.e., a crossing such as 17. Various other combinations are possible such as a T joint wherein 3 rods join or a crossing of 3 poles, i.e., 6 couplings, 5 couplings or the like.

Many variations can be made in the structures shown without departing from the spirit of the invention. Although the use of clips is preferred to hold the couplings to the membrane, other known fastening means can be employed. Although the tent has been illustrated as a hemisphere, it can take other forms such as one wherein the base describes an oval.

I claim:

1. A dome structure comprising a plurality of stressed poles each pole being flexed into an arcuate shape to exert a force in a direction which is radially outward of each pole, said poles crossing each other at a plurality of intersections, said poles having terminal ends defining a plane, said poles comprising a plurality of rods held in end-to-end relationship by couplings, a flexible membrane beneath said poles, said couplings being attached to said membrane and holding said poles in intersecting relationship at each of said plurality of intersections, said couplings engaging each of said poles substantially at the point of intersection of said poles and holding intersecting poles relative to each other at said intersections and relative to said membrane in a substantially fixed relationship, said couplings attaching said membrane to said poles and transmitting said outwardly directed force to said membrane, said membrane constituting the sole connection between spaced terminal ends of said poles.

2. The structure of claim 1 wherein said poles are composed of a plurality of short rods with coupling members having sockets to receive the ends of said rods in a loose fit.

3. The structure of claim 2 wherein a pair of crossed coupling members is employed at each intersection with a flexible member extending between the intersection and a fixed point on the membrane.

4. The structure of claim 2 wherein a pair of crossed coupling members is employed at each intersection with a fixed member extending between the intersection and a fixed point on the membrane.

5. The structure of claim 3 wherein each coupling member has a transverse hole therein with a cord passing through the holes of the coupling members and being attached to the membrane.

6. The structure of claim 2 wherein a pair of couplings is employed at each intersection, said couplings being fastened together at a fixed angle.

7. The structure of claim 2 wherein said coupling members are attached to said membrane whereby said rods can be removed from said structure without detaching said coupling members from said membrane.

8. The structure of claim 1 wherein the couplings attaching the membrane to the poles have a clip attached to said membrane, said clip having a ring lying on the outer surface of the member and with a disc which lies under the membrane and is pushed into the ring to lock the ringed disc to the membrane.

* * * * *